US007717583B2

(12) United States Patent
Tuan

(10) Patent No.: US 7,717,583 B2
(45) Date of Patent: May 18, 2010

(54) RESPONSIVE LUMINOUS PAD

(76) Inventor: Wei-Jei Tuan, P.O. Box 166-13, Taipei (TW) 115

( * ) Notice: Subject to any disclaimer, the term of this patent is extended or adjusted under 35 U.S.C. 154(b) by 75 days.

(21) Appl. No.: 12/003,403

(22) Filed: Dec. 26, 2007

(65) Prior Publication Data

US 2009/0168408 A1 Jul. 2, 2009

(51) Int. Cl.
*F21V 21/08* (2006.01)

(52) U.S. Cl. ..... 362/103; 362/249.02; 362/295; 362/394; 362/570

(58) Field of Classification Search ..... 362/103, 362/105–106, 249.05, 295, 394, 555, 570, 362/249.02
See application file for complete search history.

(56) References Cited

U.S. PATENT DOCUMENTS 5,848,830 A * 12/1998 Castle et al. ..... 362/84
6,354,712 B1 * 3/2002 Anteby ..... 362/103
7,207,688 B2 4/2007 Yuen et al.
7,262,557 B1 8/2007 Wang
7,267,452 B2 9/2007 Esses
7,278,758 B2 10/2007 Esses
7,390,103 B2 * 6/2008 Chang ..... 362/154

* cited by examiner

*Primary Examiner*—Jason Moon Han

(57) ABSTRACT

A responsive luminous pad includes a luminous module (10), and a pad (20) encloses the module (10) to a middle portion inside the pad (20). The module (10) includes a harden plastics (15) further encloses a printed circuit board (PCB) (11), a battery (12), light emitting diode (LED) (13), rolling ball switch (14), and integrated circuit (IC) processor (16) inside the plastics. Said pad (20) includes a waterproof first sheet (22B), and a waterproof second sheet (22A) printed with patterns. Rims of both first, second sheets (22B, 22A) are heat weld to form a cavity in between for receiving the luminous module (10) a widened middle portion inside the pad, and the rims further coupled to a surface of a textile (30).

13 Claims, 8 Drawing Sheets

RESPONSIVE LUMINOUS PAD

FIELD OF THE INVENTION

The invention is related to a responsive luminous pad coupled to a textile, particularly to the pad emitting light triggered by any feeble movements.

BACKGROUND OF THE INVENTION

Small size luminous modules are popular in daily life; normally, a luminous module includes a printed circuit board (PCB), a light emitting diode (LED) electrically connected to the PCB, the LED emits light in sequence or at random relative to an integrated circuit (IC) processor, a battery supplies power to the LED and IC processor, a pressure sensitive switch outputs signals to the IC processor when triggered by an outer force. Luminous module applied to shoes and numerous products has been disclosed in U.S. Pat. No. 7,207,688 entitled "interactive shoe light device" to Wong Wai Yuen on Apr. 24, 2007, or U.S. Pat. No. 7,262,577 entitled "apparatus for illuminating footwear" to Zhong Wang on Aug. 28, 2007.

Components of luminous module must be very compact so as to focus on light emission; people easily catch sight of lit module. Persons skill in the art have provided small size luminous modules applied to clothing and socks, such as U.S. Pat. No. 7,278,758 entitled "motion-responsive illuminated garment" to Ezra Esses on Oct. 9, 2007 and U.S. Pat. No. 7,267,452 entitled "motion-responsive illuminated stocking" to Eara Esses on Sep. 11, 2007.

As above, a luminous module (26) sealed inside an elastic cover (20) made of plastics, since the cover (20) is directly coupled to a clothing (12), moisture permeation easily induced inside the elastic cover (20) via the clothing (12) extended alongside. When laundering, water also permeates into the elastic cover (20). Moisture retained inside the elastic cover (20) clouded an inner wall of the elastic cover, covered it with condensation. Light emission of the luminous module (26) is therefore a mere blur.

Prior to said luminous module (26) fixed to the clothing (12), a surface of the clothing must be leveled off for attaching the luminous module thereon. Then a rim of the elastic cover (20) is heat weld to a surface of the clothing or sock. During welding, as the luminous module (26) still placed on a woven material, which is easily folding into ridges or combined with laces, braids, and plaits; so workers have to pay attentions to whether the luminous module (26) moved around above the clothing.

Furthermore, the luminous module (26) is enclosed by a plastic capsule (24) in the prior arts, but problems of moisture clouded inside the inner wall of the luminous module (26) still could not get better solutions.

In addition, the elastic cover (20) in a largest dimension size may surpass the luminous module (26) all around; the luminous module (26) is therefore easily glided along inside the elastic cover (20). In other words, the elastic cover (20) leaves a desolate space, where the luminous module (26) could not be fixed to a widened middle portion inside the elastic cover (20). Therefore, the luminous module (26) is easily inclined and glided to a bottom portion of the elastic cover (20) to emit light in a blur.

The elastic cover (20) is made of plastics, such as polyvinyl chloride (PVC), when heat weld to surface of clothing or sock, interlacing strands of fabric may be swollen and then shrunk back to induce the surface folding into ridges.

Or, pressure sensitive switch of the prior arts is mainly a spring contact switch comprises a conducting sleeve (42), and a spring coil (44) inside the sleeve. Said spring coil (44) normally is out of contact with an inner wall of the sleeve (42). When vibrated, a free end of the spring coil (44) is swayed in contact with the inner wall of the sleeve (42) to conduct electricity. An IC processor (34) is therefore to activate LEDs (38A~38D) to emit light in response to the electrification. However, the spring coil must be swayed sufficiently to contact with the inner wall of the sleeve; other than a sufficient swaying, it will not conduct electricity power. In other words, it depends to a large extent upon whether the spring coil is bounced back and forth sufficiently to span across a gap in between, which leads to the spring coil is only suitable for shoes, but not for clothing, hats, or socks.

SUMMARY OF THE INVENTION

Point against aforesaid problems, the present invention is to provide a responsive luminous pad (1) includes a luminous module (10), and a pad (20) for receiving the luminous module (10).

Said luminous module (10) includes a printed circuit board (PCB), a battery (11) disposed below the PCB supplies power to the PCB, a plurality of light emitting diodes (LEDs) (13) lit or dimmed by a rolling ball switch (14) are all disposed on the PCB, said PCB, said battery, and said rolling ball switch are all enclosed by a harden plastics (15) pervious to light.

Said pad (20) includes a waterproof first sheet (22B) pervious to light as a base; and a waterproof second sheet (22A) provided with patterns covering the first sheet (22B) as a cover. Rims of both sheets (22A, 22B) are sealed by high frequency waves to form a cavity in between. The cavity is designed for receiving the luminous module (10). The luminous module (10) is fixed to a widened middle portion inside the pad (20). Sealed rims (22C) are coupled to a surface of the pad (30).

The pad (20) is inflated with air or helium to absorb shock. Air or helium occupies 30~70% space inside the pad.

DETAILED DESCRIPTION OF THE INVENTION

The description is described in detail according to the appended drawings hereinafter.

Figure 1:
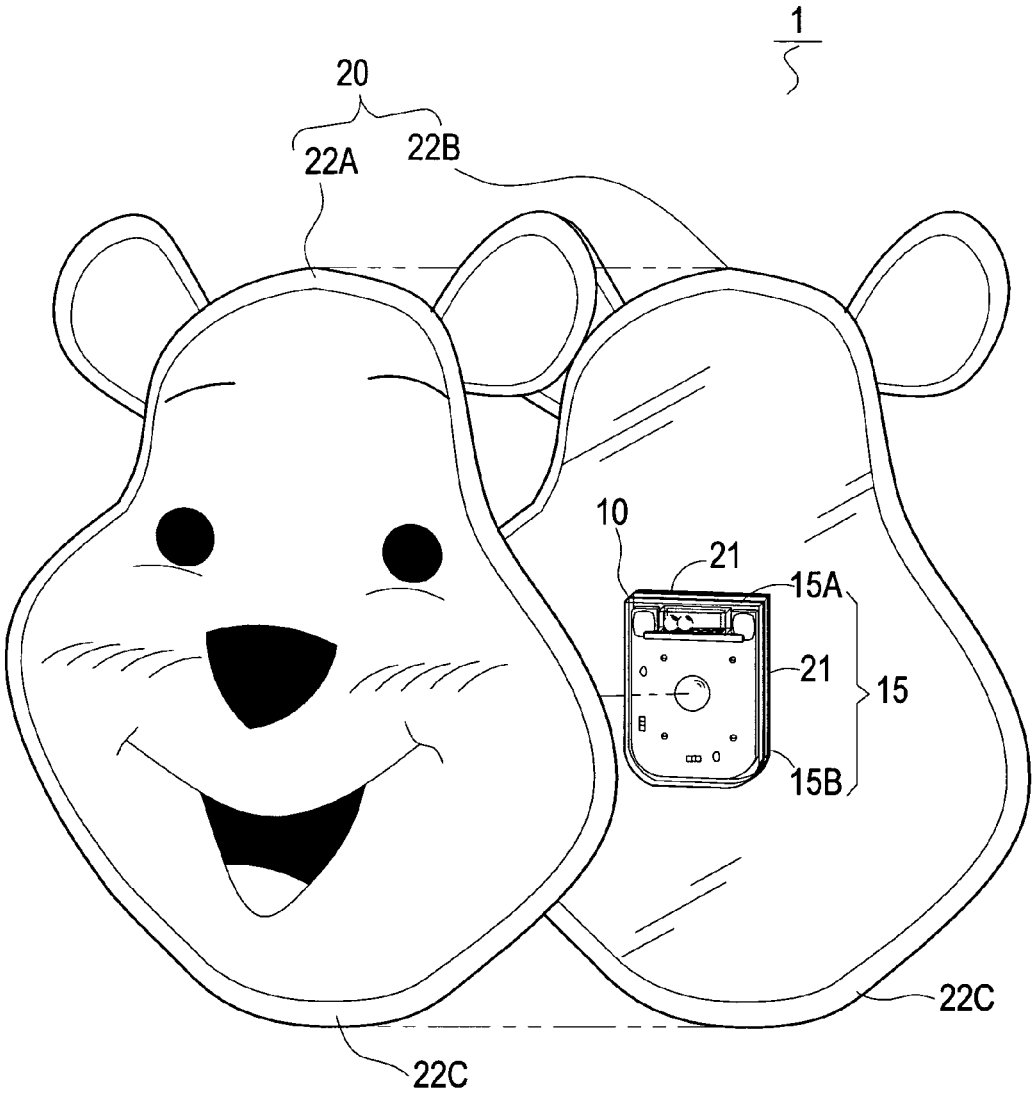
FIG. 1: is an exploded view of the responsive luminous pad.
Figure 2:
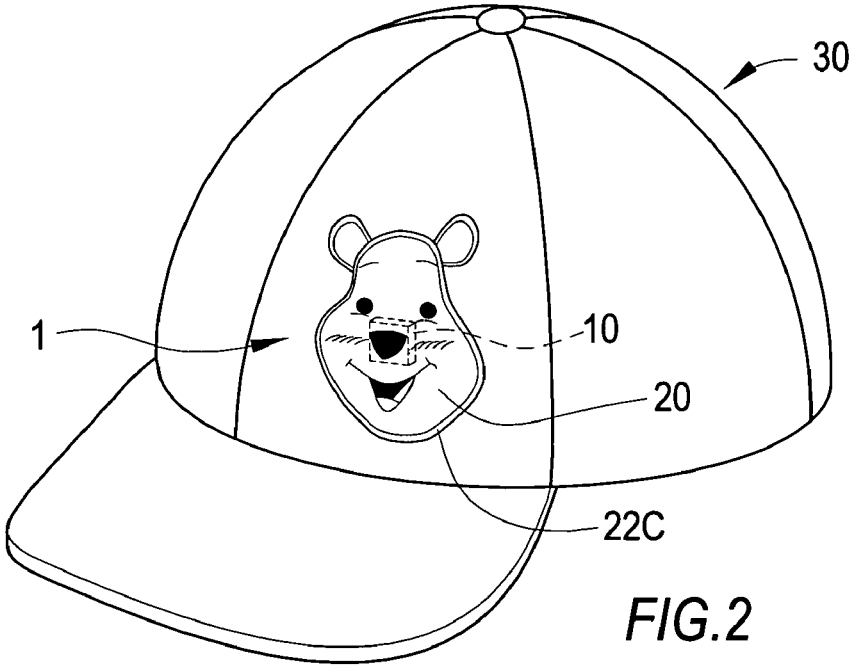
FIG. 2: is a plan view of the responsive luminous pad attached to a surface of a hat.
Figure 3:
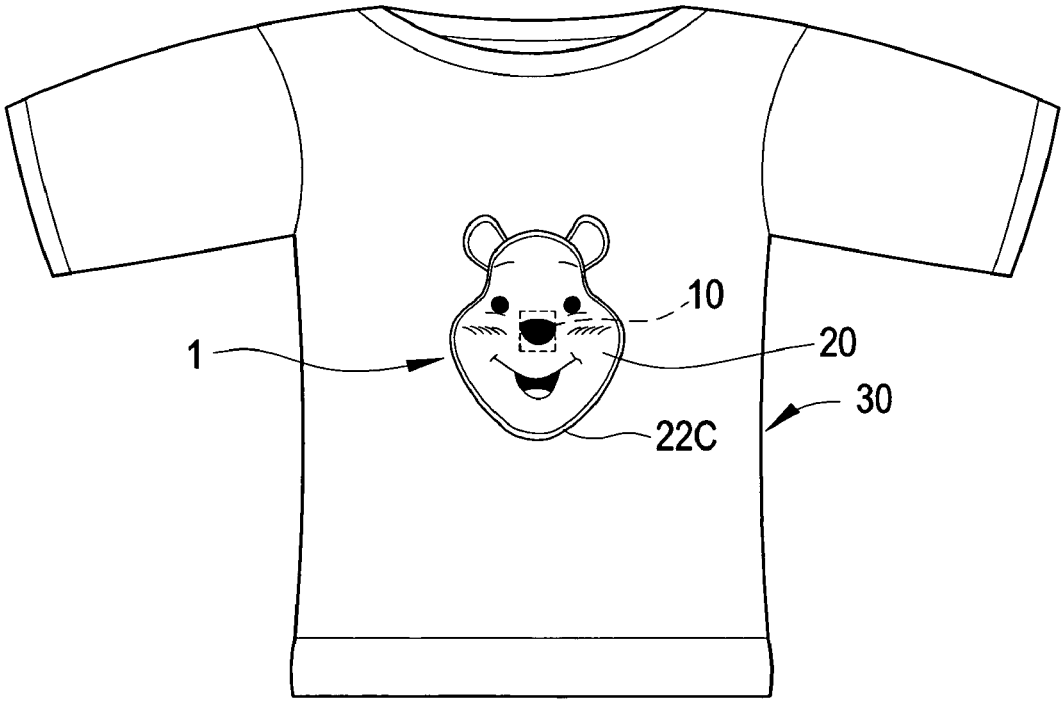
FIG. 3: is an elevational view of the responsive luminous pad attached to surface of a clothing.

As shown in FIGS. 1~3, a responsive luminous pad (1) includes a luminous module (10), and a pad (20) for receiving the luminous module (10). Rims (22*c*) of said pad (20) are sealed together to form a cavity inside the pad. The luminous module (10) is disposed inside the cavity and fixed to a widened middle portion inside the pad.

Figure 4:
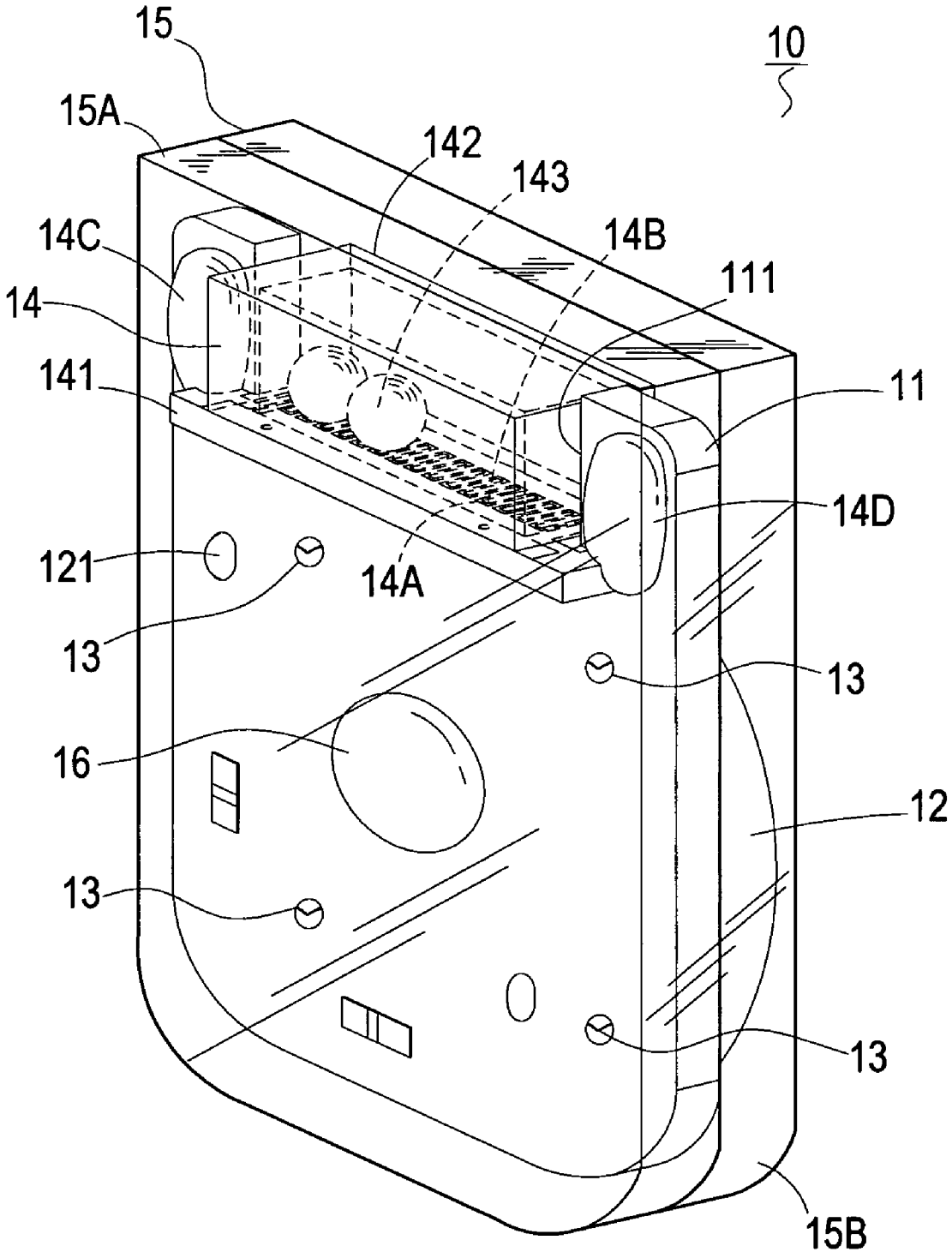
FIG. 4: is a sectional view of the assembled luminous module.
Figure 5:
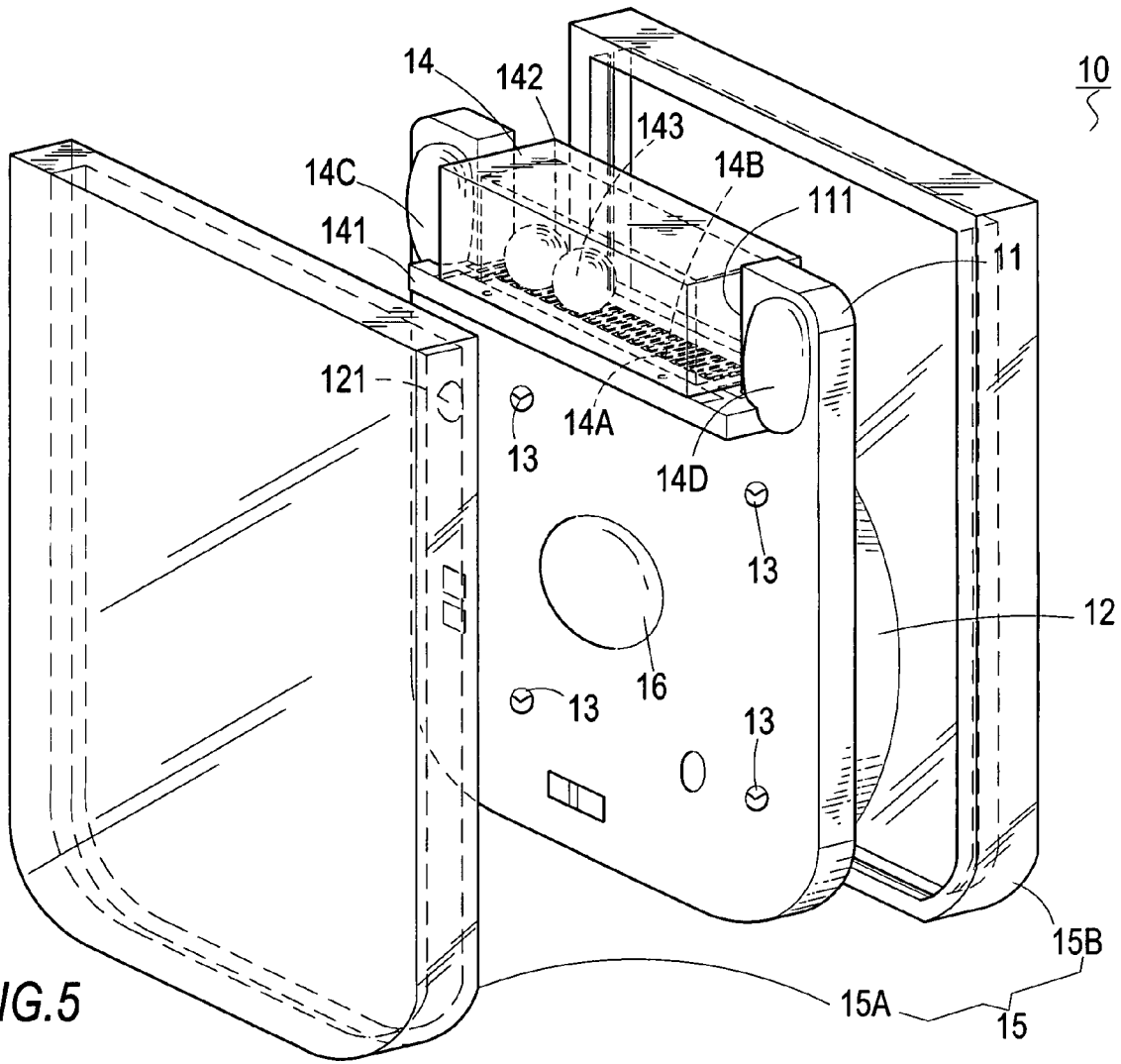
FIG. 5: is a sectional view of the luminous module broken down in part for showing the module is sandwiched between two housings.
Figure 6:
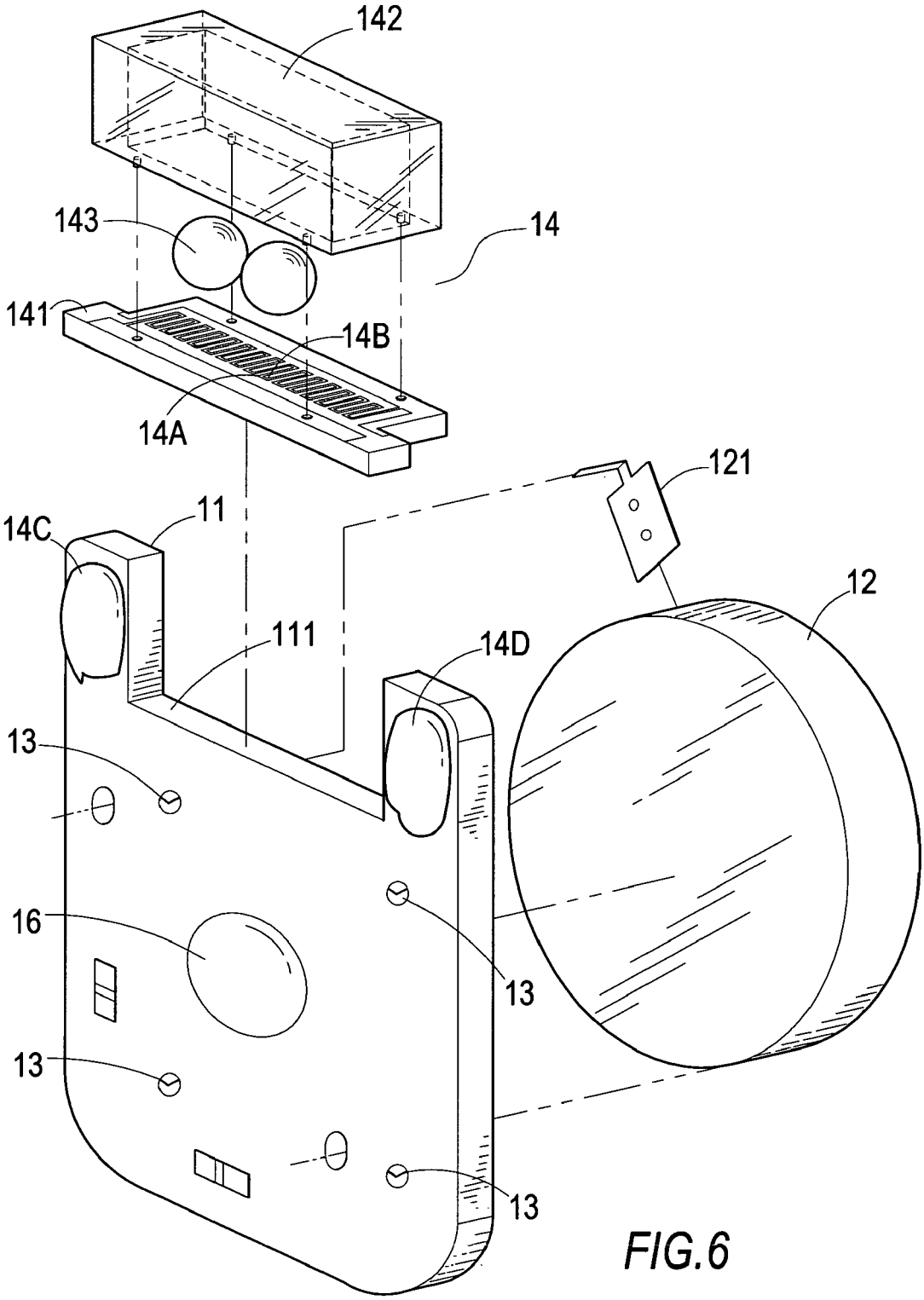
FIG. 6: is an exploded view of the luminous module broken down for showing the printed circuit board (PCB) and the rolling ball switch.

As shown in FIGS. 4~6, said luminous module (10) includes a printed circuit board (PCB) (11), a battery (12) disposed below the PCB (11) for supplying power to the PCB (11); an integrated circuit (IC) processor (16), a plurality of light emitting diodes (LEDS) (13), and a rolling ball switch (14) determines whether lights the LEDs, or dims the LEDs. Both LEDs and the rolling ball switch are disposed on the PCB and electrically connected to the battery. Said PCB, said LEDs, and said battery are enclosed by a harden plastics (15) pervious to light.

Said rolling ball switch (14) includes a circuit substrate (141) electrically connected to the PCB (11), a cover (142) fits over the circuit substrate (141), and, at least, a metallic rolling ball (143) is electrically connected to the circuit substrate (141) inside the cover (142) by rolling across circuits printed on a first surface of the circuit substrate (141) sealed inside the cover (142) facing inward. Said circuit substrate (141) is printed with pairs of conduction portions (14A, 14B) equidistantly distributed in parallel on the first surface of the circuit substrate. A small gap existed between each pairs of the conduction portions (14A, 14B) is obviously smaller than a radius of the rolling ball (413). Said rolling ball (143) moves around the circuit substrate, when encountered a little vibration happened to the luminous module (10). Such a motion makes the conduction portions (14A, 14B) are in contact with the rolling ball (143) immediately conduct electricity power to the IC processor (16), in turn, LEDs (13) are lit up in sequence.

A concaved surface (111) formed on the PCB (11) is adapted for the rolling ball switch (14) received therein. At the same time, both ends of the circuit substrate (141) heat weld to the PCB (11) by welding points (14C, 14D). One electrode (for example, anode) of the battery (12) is directly and electrically connected to the PCB (11), the other electrode (for example, cathode) is electrically connected to the PCB (11) indirectly by an L shaped clip (121). Thereby, both negative and positive electric flows can be conducted to the PCB (11).

Said harden plastics (15) pervious to light is composed of a front and rear transparent housings (15A, 15B). Both flanges around the housings (15A, 15B) correspondingly oppose to each other are spread with waterproof adhesive, and then the housings are assembled together to form a waterproof plastics (15) by ultrasonic waves. Assembly of the luminous module (10) is therefore sooner and more convenient than injection of epoxy encloses the PCB etc., to form a conventional luminous module.

Figure 7:
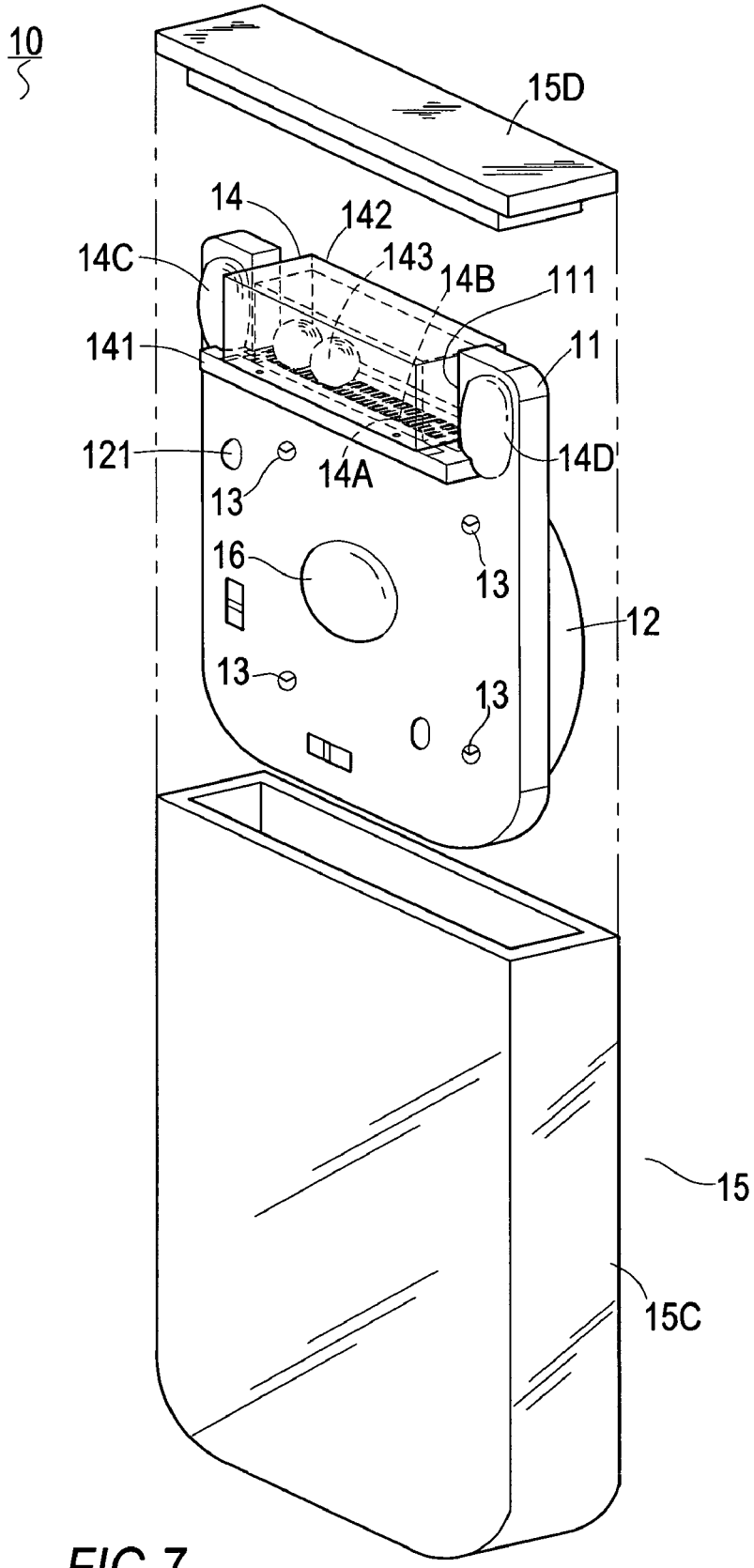
FIG. 7: is a schematic view of an alternate embodiment of the luminous module.

Next, as shown in FIG. 7, an alternate embodiment of the luminous module is illustrated. The plastics (15) pervious to light is composed of a transparent box (15C) formed by injection molding, and a transparent cover (15D) also by injection molding. An opening formed at a top end of the box (15C) accommodates the PCB (11) disposed with the battery (12), the LEDs (13), the rolling ball switch (14), and the IC processor (16) received therein. Then the cover (15D) is applied to seal the top opening of the box (15C). In addition, the cover (15D) is sealed to the box (15C) by waterproof adhesive or ultra sonic waves. In the same token, the alternative embodiment assembly of the luminous module (10) is therefore sooner and more convenient than injection of epoxy encloses the PCB etc., to form a conventional luminous module.

Figure 8:
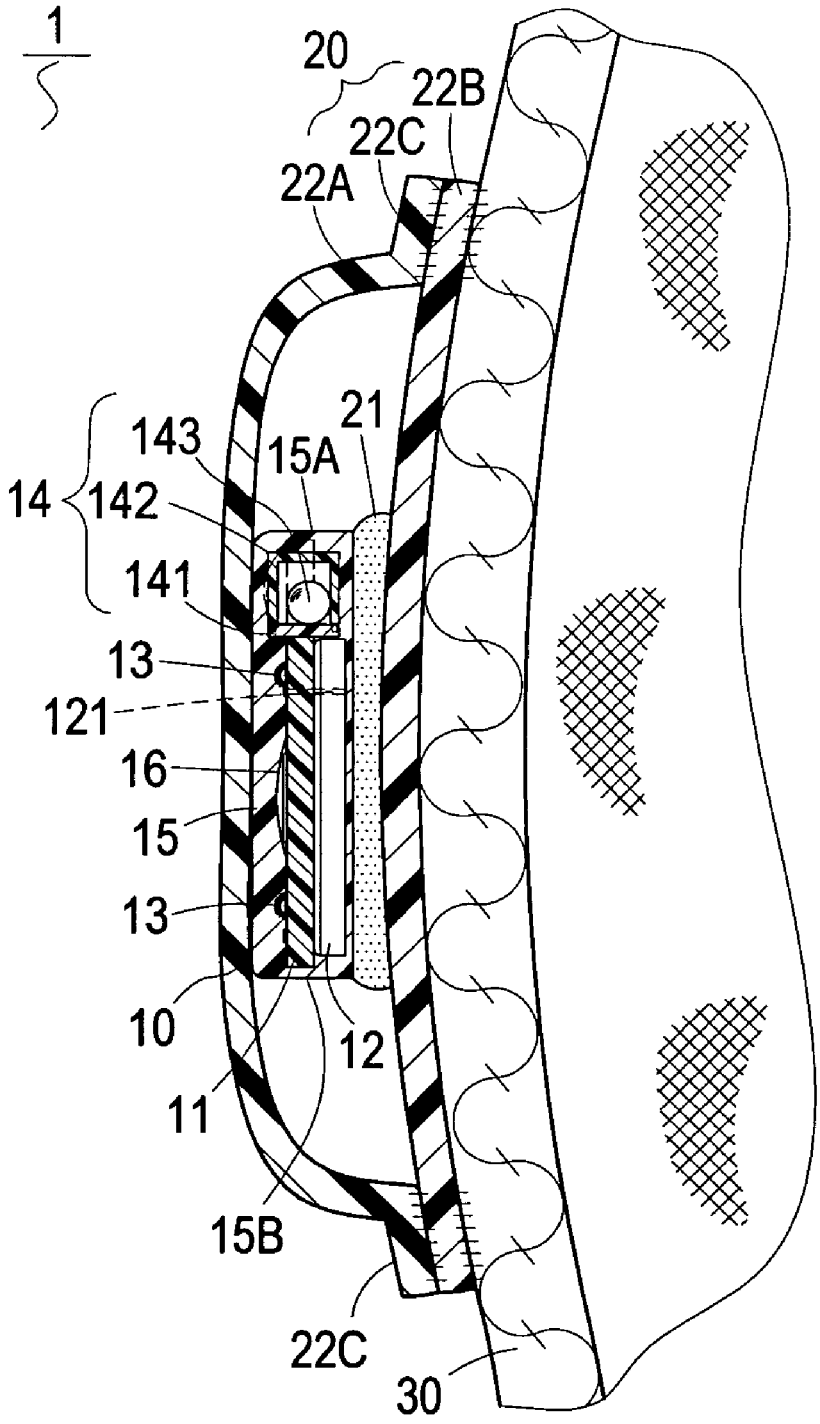
FIG. 8: is a sectional view of an embodiment of the present invention.

As shown in FIGS. 1 and 8, said pad (20) includes a waterproof first sheet (22B) pervious to light; and a waterproof second sheet (22A) pervious to light printed with patterns. Said waterproof first and second sheets (22A, 22B) are made from polyvinyl chloride (PVC). Rims of the first and second sheets (22A, 22B) are sealed together by high frequency waves to form a cavity in between for receiving the luminous module (10) therein. The luminous module (10) is further fixed to a widened middle portion inside the pad (20). Sealed rims (22C) are further coupled to a surface of a textile (30), which is subject to the pad (20) decorated thereto for showing light emissions.

Sealed pad (20) is inflated filled with air or helium (24); the second sheet (22A) is therefore avoided from folding into ridges. And the pad (20) filled with air, or helium absorbs shock to prevent from damages happened to the luminous module (10). Said air or helium (24) occupies 30~70% space inside the pad (20). More than 70% air or helium, the pad full with air or helium is easy broken to cause frictional damages by impacts. Less than 30% air or helium, the pad is easily folded into ridges on the second sheet or out of shape.

Said luminous module (10) is attached to the first sheet (22B) by adhesive (21) or ultra sonic waves. After affixing to the first sheet (22B), the luminous module (10) is not separated from the first sheet (22B) to move around above the first sheet. Said adhesive (21) is selected from one of the following: hot melt glue, super glue, or silica gel.

Since moisture dies away from the pad (20) due to the pad is already filled with air or helium, but not mixed with moisture or water vapor, therefore, moisture could not infiltrate into the pad. Even the pad (20) coupled to a surface of the textile (30); the moisture will not cloud from the textile to the pad to condense into water vapor to ensure 100% waterproof effect.

Figure 9:
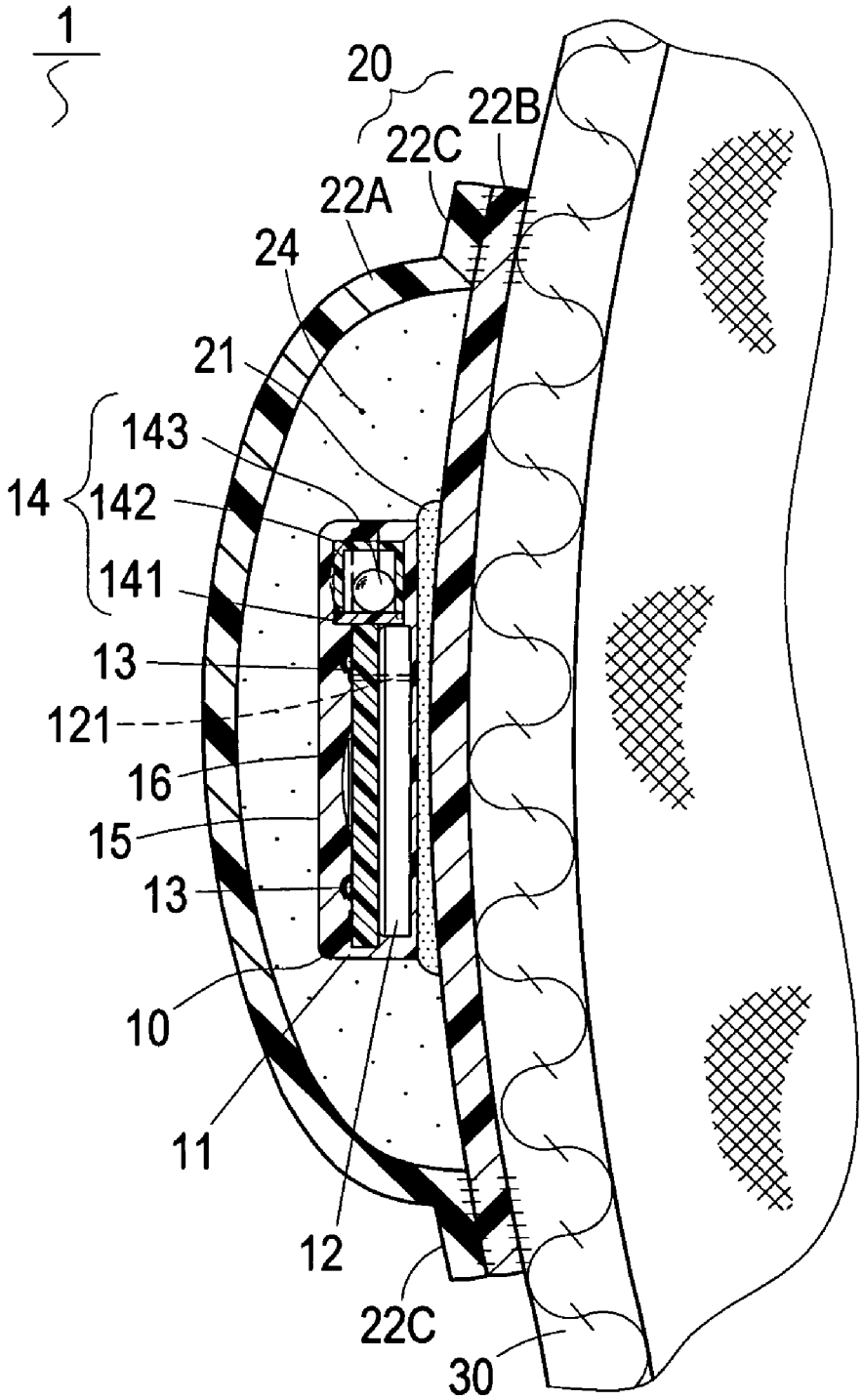
FIG. 9: is a sectional view of an alternative embodiment of the present invention.

As shown in FIG. 9, the pad (20) is filled with air or helium to absorb shock. Said air or helium (24) occupies 30~70% space inside the pad (20). More than 70% air or helium, the pad full with air or helium is easy to be drifted along on the textile. Less than 30% air or helium, the pad is out of shape without absorption of shock effect.

Next, the sealed rims (22C) of the pad (20) fixed to a surface of the textile (30) by high frequency waves or by stitching. Such as clothing, sock made of cotton, nylon can be sealed together with the pad (20) by high frequency waves; clothing, sock made of wool, silk, or leather can be sealed together with the pad (20) by stitching.

As above, the pad (20) is composed of a translucent first sheet (22B) made of cloth, and a translucent second sheet (22A) made of cloth provided with patterns. Rims (22C) of the first, second sheets (22B, 22A) are sealed together by adhesive or stitching with breathable effects. Even moisture invaded into the pad (20) can be evaporated soon, no moisture clouded to condense into water vapor to blur the light emission. Said patterns can be shaped on the second sheet (22A) by printing, or electric embroidering. But the rims (23) coupled to the textile (30) is preferably by stitches.

Advantages of Embodiments of the Present Invention

The present invention can be realized to achieve advantages as following:

The luminous module (10) sealed inside the pad (20) with rims (22C) sealed together. Moisture could not invade or permeate into the pad (20), even the rims (22C) of the pad (10) is sealed by high frequency waves or stitches, further coupled to a surface of the textile (30). Moisture still does not infiltrate into the pad (20), though the textile is moist with water vapor.

Since the luminous module (10) is disposed inside the pad (20) as a finished product, which facilitates tailoring or manufacturing shoes, hats etc., to stitch or weld the module to a surface of the shoe, hat, pack or clothes.

Next, the luminous module (10) is fixed to a widened middle portion inside the pad (20). After affixing, the luminous module (10) is not moved about above the first sheet inside the roomy pad (20).

Further, the pad (20) is inflated filled with air or helium (24) to avoid the second sheet from folding into ridges. Furthermore, the inflated pad (20) can absorb shock to prevent impacts from causing damages to the luminous module (10).

Moreover, the rolling ball switch (14) encountered a little vibration, a metallic rolling ball (143) moves around the circuit substrate (141) in contact with both conduction portions (14A, 14B) to activate the IC processor (16), which is therefore responsive to electrify the LEDs more sensitive than the conventional coil spring. When the pad (20) is coupled to a surface of the textile (30), the rolling ball switch in response to a little vibration can trigger IC processor to light LEDs sooner and better than the prior arts.

What is claimed is:

1. A responsive luminous pad comprising: a luminous module (10) includes a printed circuit board (PCB) (11), a battery (12) disposed below the PCB (11) supplies power to the PCB (11), an integrated circuit (IC) processor (16), a plurality of light emitting diodes (LEDs) (13), and a rolling ball switch (14) determines whether to light the LEDs in sequence or dim the LEDs (13), and said PCB (11), said battery (12), said LEDs (13), and said rolling ball switch (14) are enclosed inside a harden plastics (15) pervious to light; and a pad (20) includes a waterproof first sheet (22B) pervious to light, a waterproof second sheet (22A) pervious to light provided with patterns; said first, second sheets (22B, 22A) are made of plastic, rims (22C) of the first, second sheets (22B, 22A) are sealed together by high frequency waves to form a cavity in between for receiving the luminous module (10), which is fixed to a widened middle portion inside the pad (20); the sealed rims (22C) is further coupled to a surface of a textile, wherein the pad (20) is inflated filled with air (24) to avoid the second sheet (22A) from folding into ridges, and the inflated pad absorbs shock (30).

2. The responsive luminous pad of claim 1 wherein the air (24) occupies 30~70% space inside the pad (20).

3. The responsive luminous pad of claim 1 wherein the luminous module (10) is attached to the first sheet (22B) by an adhesive (21).

4. The responsive luminous pad of claim 1 wherein the luminous module (10) is attached to the first sheet (22B) by ultra sonic waves.

5. The responsive luminous pad of claim 1 wherein the rolling ball switch (14) includes a circuit substrate (141) is electrically connected to the PCB (11), a cover (142) fits over the Circuit substrate (141), and, at least, one metallic rolling ball moved on the printed circuit on a first surface of the substrate (141) to be electrically connected thereto; said substrate (141) has pairs of conduction portions (14A, 14B) in parallel equidistantly distributed on the first surface.

6. The responsive luminous pad of claim 1 wherein the sealed rims (22C) of the pad (20) is sealed together to a surface of the textile (30) by high frequency waves.

7. The responsive luminous pad of claim 1 wherein the harden plastic (15) pervious to light is assembled by a front and back transparent housings (15A, 15B) shaped by injection molding.

8. The responsive luminous pad of claim 1 wherein said harden plastics (15) pervious to light is assembled by a transparent box (15C) with a top end opening shaped by injection molding, and a transparent cover (15D) by injection molding for sealing said opening.

9. The responsive luminous pad of claim 1 wherein said textile (30) is pack.

10. The responsive luminous pad comprising: a luminous module (10) includes a PCB (printed circuit board) (11), a battery (12) disposed below the PCB (11) supplies power to the PCB (11), an IC (integrated circuit) processor (16), a plurality of LEDs (light emitting diodes) (13), and a metallic rolling ball switch (14) determines whether to light the LEDs in sequence or dim the LEDs (13) that are all disposed on the PCB (11); said PCB (11), said battery (12), said LEDs (13), and said rolling ball switch (14) are enclosed inside a harden plastics (15); and a pad (20) includes a translucent first sheet (22B), and a translucent second sheet (22A) provided with patterns; rims of said first and second sheets (22B, 22A) sealed together to form a cavity in between for receiving the luminous module (10), which is fixed to a widened middle portion inside the pad (20); the sealed rims (22C) is coupled to a surface of a textile, wherein the pad (20) is inflated filled with air (24) to avoid the second sheet (22A) from folding into ridges, and the inflated pad absorbs shock (30).

11. The responsive luminous pad of claim 10 wherein the sealed rims (22C) is coupled to the surface of the textile by stitches.

12. The responsive luminous pad of claim 10 wherein the harden plastics (15) pervious to light is assembled by a front and back housings (15A, 15B).

13. The responsive luminous pad of claim 10 wherein the harden plastics (15) is assembled by a transparent box (15C) with a top end opening, and a cover (15D) for covering said box (15C).

* * * * *